US012241667B2

(12) United States Patent
Shen et al.

(10) Patent No.: US 12,241,667 B2
(45) Date of Patent: Mar. 4, 2025

(54) AIR CONDITIONER SYSTEM

(71) Applicant: CARRIER CORPORATION, Palm Beach Gardens, FL (US)

(72) Inventors: Guangyu Shen, Shanghai (CN); Tingting Wang, Shanghai (CN); Keqiao Li, Shanghai (CN); Shen Li, Shanghai (CN); Jinxiang Wang, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 188 days.

(21) Appl. No.: 16/973,667

(22) PCT Filed: May 6, 2020

(86) PCT No.: PCT/US2020/031629

§ 371 (c)(1),
(2) Date: Dec. 9, 2020

(87) PCT Pub. No.: WO2020/227378

PCT Pub. Date: Nov. 12, 2020

(65) Prior Publication Data

US 2022/0049881 A1 Feb. 17, 2022

(30) Foreign Application Priority Data

May 7, 2019 (CN) ..... 201910375083.5

(51) Int. Cl.
*F25B 41/22* (2021.01)
*F25B 13/00* (2006.01)

(52) U.S. Cl.
CPC ..... *F25B 41/22* (2021.01); *F25B 13/00* (2013.01); *F25B 2313/02741* (2013.01); *F25B 2313/0292* (2013.01)

(58) Field of Classification Search
CPC ..... F25B 41/22; F25B 13/00; F25B 2313/02741; F25B 2313/0292
See application file for complete search history.

(56) References Cited

U.S. PATENT DOCUMENTS 5,687,678 A * 11/1997 Suchomel ..... F28D 7/024 122/249
2004/0148950 A1* 8/2004 Catzel ..... F24F 3/08 62/238.7

(Continued)

FOREIGN PATENT DOCUMENTS

CN 2879030 Y * 3/2007
CN 201037714 Y * 3/2008

(Continued)

OTHER PUBLICATIONS

Yan, New Type Air Source Hot Pump Water Heater, Mar. 14, 2007, CN2879030Y, Whole Document (Year: 2007).*

(Continued)

*Primary Examiner* — Larry L Furdge
(74) *Attorney, Agent, or Firm* — CANTOR COLBURN LLP

(57) ABSTRACT

An air conditioning system including a four-way valve including a first port, a second port, a third port and a fourth port, at least the first port and the third port are fluidly isolated; a compressor, an output end and an input end of which are in communication with the first port and the third port respectively; a first evaporator, a first end of which is in communication with the third port; a second evaporator and a condenser, first ends of which are in communication with one of the second port and the fourth port respectively; wherein a second end of the condenser, a second end of the first evaporator, and a second end of the second evaporator are in communication at a first node, and a first throttling valve, a second throttling valve and a third throttling valve are respectively disposed between the condenser and the first node.

8 Claims, 3 Drawing Sheets

(56) References Cited

U.S. PATENT DOCUMENTS

| | | | | |
|---|---|---|---|---|
| 2006/0277931 | A1* | 12/2006 | Nakamura | F25B 1/10 62/196.1 |
| 2015/0354713 | A1 | 12/2015 | Hancock | |
| 2019/0011154 | A1 | 1/2019 | Takizawa | |
| 2019/0195539 | A1* | 6/2019 | Akaiwa | F25B 6/02 |

FOREIGN PATENT DOCUMENTS

| | | | | |
|---|---|---|---|---|
| CN | 201138023 | Y | * | 10/2008 |
| CN | 104165475 | A | * | 11/2014 |
| CN | 108507207 | A | | 9/2018 |
| JP | 2010236831 | A | | 10/2010 |

OTHER PUBLICATIONS

Wang, High-efficient Multifunctional Air Conditioning Device, Oct. 22, 2008, CN201138023Y, Whole Document (Year: 2008).*

Liu et al., An Oil Balance Device of Multi-connected Air Conditioning System and Heating Method, Nov. 26, 2014, CN104165475A, Whole Document (Year: 2014).*

Yiquiang, High Effective Multifunctional Air Energy Source Set, Mar. 19, 2008, CN201037714Y, Whole Document (Year: 2008).*

International Search Report issued in Application No. PCT/US2020/031629 on Aug. 14, 2020, 5 pages.

Written Opinion issued in Application No. PCT/US2020/031629 on Aug. 14, 2020, 8 pages.

* cited by examiner

AIR CONDITIONER SYSTEM

CROSS REFERENCE TO RELATED APPLICATIONS

This application is a National Stage application of PCT/US2020/031629, filed May 6, 2020, which claims the benefit of Chinese Application No. 201910375083.5, filed May 7, 2019, both of which are incorporated by reference in their entirety herein.

FIELD OF THE INVENTION

The present application relates to the field of the structure of an air conditioning system. More specifically, the present application relates to an air conditioning system, which aims to provide additional working modes.

BACKGROUND OF THE INVENTION

A Heating, Ventilation and Air Conditioning (HVAC) system often includes an air conditioning system. A typical air conditioning system includes a compressor, a condenser, an evaporator and a four-way valve for communicating various components. The four-way valve is configured to selectively change the flow direction of a high-pressure refrigerant flowing from the compressor, thereby providing cooling cycle or heating cycle. In an existing HVAC system, the cooling cycle or the heating cycle of the air conditioning system is configured to provide cold water alone or provide hot water alone. Therefore, such type of air conditioning system uses coils and heat exchangers to serve as condenser-evaporator devices.

However, due to limitations by the structure of the flow path of the air conditioning system, the existing air conditioning systems can only provide the cooling cycle alone or the heating cycle alone at the same time. With user's increasing requirements on the air conditioning system, there arises a demand for simultaneous cooling and heating. The existing air conditioning systems are not able to meet the above demand due to the limitations by the structure of the flow path thereof.

Therefore, there is an ongoing need in the art for an improved air conditioning system, and it is desirable that new solutions can provide more options of working modes for users.

SUMMARY OF THE INVENTION

An object of one aspect of the present application is to provide an air conditioning system, which aims to provide additional working modes to meet the demand of on-site operation.

The object of the present application is achieved by the following technical solutions:

an air conditioning system, includes:

a four-way valve including a first port, a second port, a third port and a fourth port, wherein at least the first port and the third port are fluidly isolated;

a compressor, an output end and an input end of which are in fluid communication with the first port and the third port respectively;

a first evaporator, a first end of which is in fluid communication with the third port;

a second evaporator, a first end of which is in fluid communication with one of the second port and the fourth port;

a condenser, a first end of which is in fluid communication with the other of the second port and the fourth port;

wherein a second end of the condenser, a second end of the first evaporator, and a second end of the second evaporator are in fluid communication at a first node, and a first throttling valve, a second throttling valve and a third throttling valve are respectively disposed between the condenser and the first node, between the first evaporator and the first node, as well as between the second evaporator and the first node.

In the above air conditioning system, optionally, the four-way valve has a first state and a second state, wherein in the first state, the first port is in fluid communication with the second port, and the third port is in fluid communication with the fourth port; and in the second state, the first port is in fluid communication with the fourth port, and the second port is in fluid communication with the third port.

In the above air conditioning system, optionally, the condenser includes a finned coil and a fan.

In the above air conditioning system, optionally, the evaporator includes a plate heat exchanger.

In the above air conditioning system, optionally, the first throttling valve, the second throttling valve, and the third throttling valve are electronic expansion valves.

In the above air conditioning system, optionally, the air conditioning system has a first mode, wherein the four-way valve is in the first state, the third throttling valve is closed, and the first throttling valve and the second throttling valve are opened so that the first evaporator is used for cooling alone and the second evaporator does not work.

In the above air conditioning system, optionally, the air conditioning system has a second mode, wherein the four-way valve is in the first state, the second throttling valve is closed, and the first throttling valve and the third throttling valve are opened so that the second evaporator is used for cooling alone and the first evaporator does not work.

In the above air conditioning system, optionally, the air conditioning system has a third mode, wherein the four-way valve is in the first state, and the first throttling valve, the second throttling valve, and the third throttling valve are opened so that the first evaporator and the second evaporator are used for cooling together.

In the above air conditioning system, optionally, the air conditioning system has a fourth mode, wherein the four-way valve is in the second state, the second throttling valve is closed, and the first throttling valve and the third throttling valve are opened so that the second evaporator is used for heating and the first evaporator does not work.

In the above air conditioning system, optionally, the air conditioning system has a fifth mode wherein the four-way valve is in the second state, the first throttling valve is closed, and the second throttling valve and the third throttling valve are opened so that the second evaporator is used for heating and the first evaporator is used for cooling.

The air conditioning system of the present application has the advantages of simple in structure, easy for manufacturing, and convenience in use. By applying the air conditioning system of the present application, additional working modes can be provided to meet the demand of on-site operation.

BRIEF DESCRIPTION OF THE DRAWINGS

The present application will be described below in further detail with reference to the accompanying drawings and preferred embodiments, but those skilled in the art will appreciate that these drawings are drawn only for the purpose of explaining the preferred embodiments and should not be construed as limiting the scope of the present application. In addition, unless specifically stated, the drawings are only intended to conceptually represent the composition or construction of the described objects and may contain exaggerated illustration, and the drawings are not necessarily drawn to scale.

DETAILED DESCRIPTION OF THE EMBODIMENT(S) OF THE INVENTION

Figure 1:
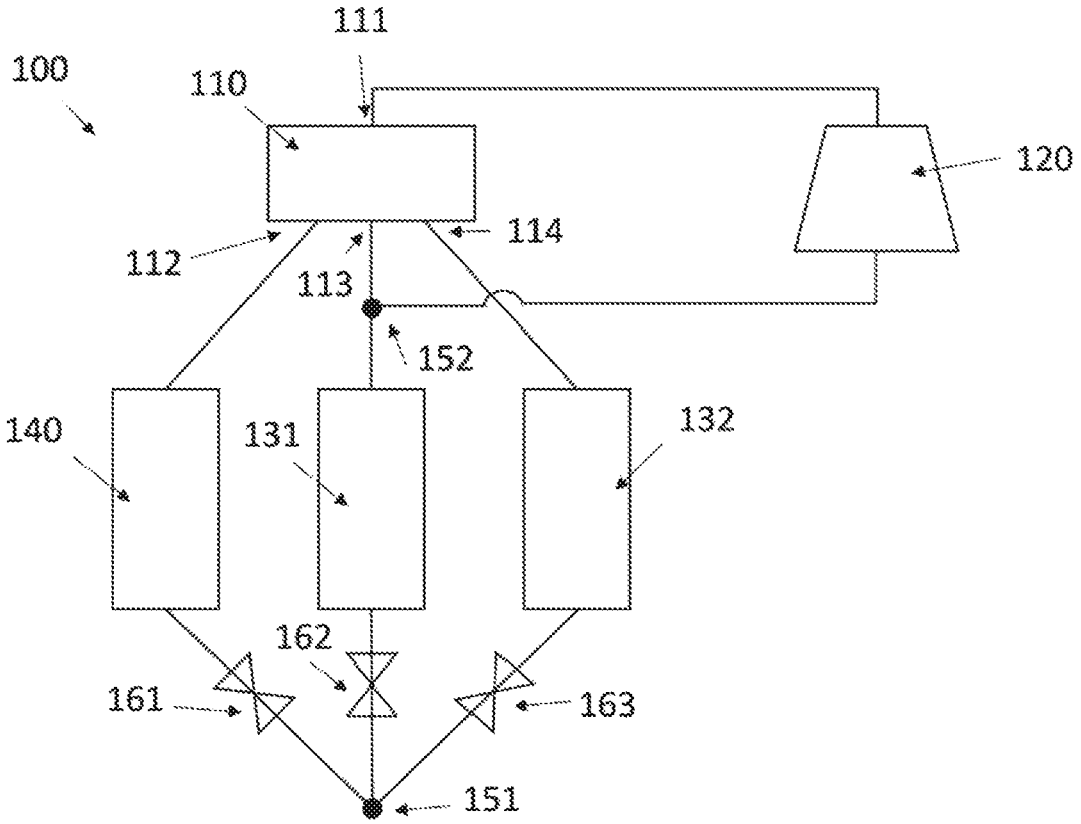
FIG. 1 is a schematic structural view of one embodiment of an air conditioning system of the present application.

Hereinafter, preferred embodiments of the present application will be described in detail with reference to the accompanying drawings. Those skilled in the art will appreciate that these descriptions are merely illustrative and exemplary, and should not be construed as limiting the scope of protection of the present application.

Firstly, it should be noted that the terms such as top, bottom, upward, and downward mentioned herein are defined with respect to the directions in various drawings, they are relative concepts, and therefore can be changed according to different positions and different states of use. Accordingly, these or other terms should not be interpreted as restrictive terms.

In addition, it should also be noted that for any single technical feature described or implied in the embodiments herein, or any single technical feature shown or implied in the drawings, it is still possible to combine these technical features (or their equivalents) so as to obtain other embodiments of the present application that are not directly mentioned herein.

It should be noted that in different drawings, identical or substantially identical components are denoted by the same reference signs.

Figure 2:
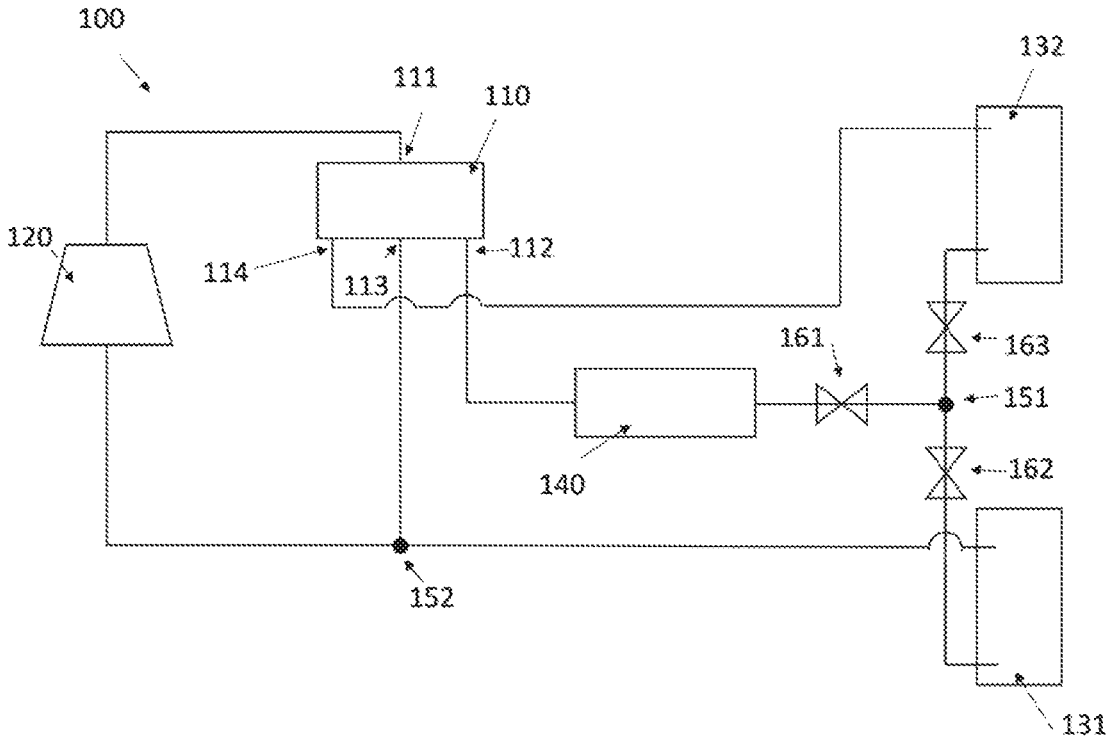
FIG. 2 is another schematic structural view of the embodiment shown in FIG. 1.

FIG. 1 is a schematic structural view of one embodiment of an air conditioning system of the present application, and FIG. 2 is another schematic structural view of the embodiment shown in FIG. 1. The air conditioning system 100 according to one embodiment of the present application includes a four-way valve 110, a compressor 120, a first evaporator 131, a second evaporator 132 and a condenser 140, as well as a first throttling valve 161, a second throttling valve 162, and a third throttling valve 163 connected in series in the pipelines.

As shown, the four-way valve 110 includes a first port 111, a second port 112, a third port 113, and a fourth port 114. It is easy to understand that each of the ports may be sequentially arranged along the periphery of the four-way valve, wherein fluid communication can be established between two adjacent ports, and no fluid communication can be established between two non-adjacent ports. In the context, the situation where no fluid communication can be established is referred to as "fluidly isolated".

The four-way valve 110 typically has at least two working states, namely, a first state and a second state. In the first state, the first port 111 is in fluid communication with the second port 112, and the third port 113 is in fluid communication with the fourth port 114; and in the second state, the first port 111 in fluid communication with the fourth port 114, and the second port 112 is in fluid communication with the third port 113.

The four-way valve may also have the structure of a conventional four-way valve. For example, for a four-way valve with D, E, S, and C connection pipes, the first port 111 may correspond to the D connection pipe, the second port 112 may correspond to the E connection pipe, the third port 113 may correspond to the S connection pipe, and the fourth port 114 may correspond to the C connection pipe. For a four-way valve with A, B, C, and D interfaces, the first port 111 may correspond to the A interface, the second port 112 may correspond to the B interface, the third port 113 may correspond to the C interface, and the fourth port 114 may correspond to the D interface.

Therefore, during normal operation, at least the first port 111 and the third port 113 are fluidly isolated, that is, no direct fluid communication can be established between the first port 111 and the third port 113. Similarly, during normal operation, the second port 112 and the fourth port 114 are fluidly isolated, that is, no direct fluid communication can be established between the second port 112 and the fourth port 114.

In the illustrated embodiment, an output end and an input end of the compressor 120 are in fluid communication with the first port 111 and the third port 113, respectively. Therefore, the first port 111 and the third port 113 are used as the input port and the output port of the refrigerant, respectively. The compressor 120 may be any known compressor. The output end of the compressor 120 is configured to output a refrigerant with a relatively higher pressure, and the input end of the compressor 120 is configured to receive a refrigerant with a relatively lower pressure.

A first end of the first evaporator 131 is in fluid communication with the third port 113. In the illustrated embodiment, the first end of the first evaporator 131 is in fluid communication with the third port 113 and the input end of the compressor 120 at a second node 152.

Figure 3:
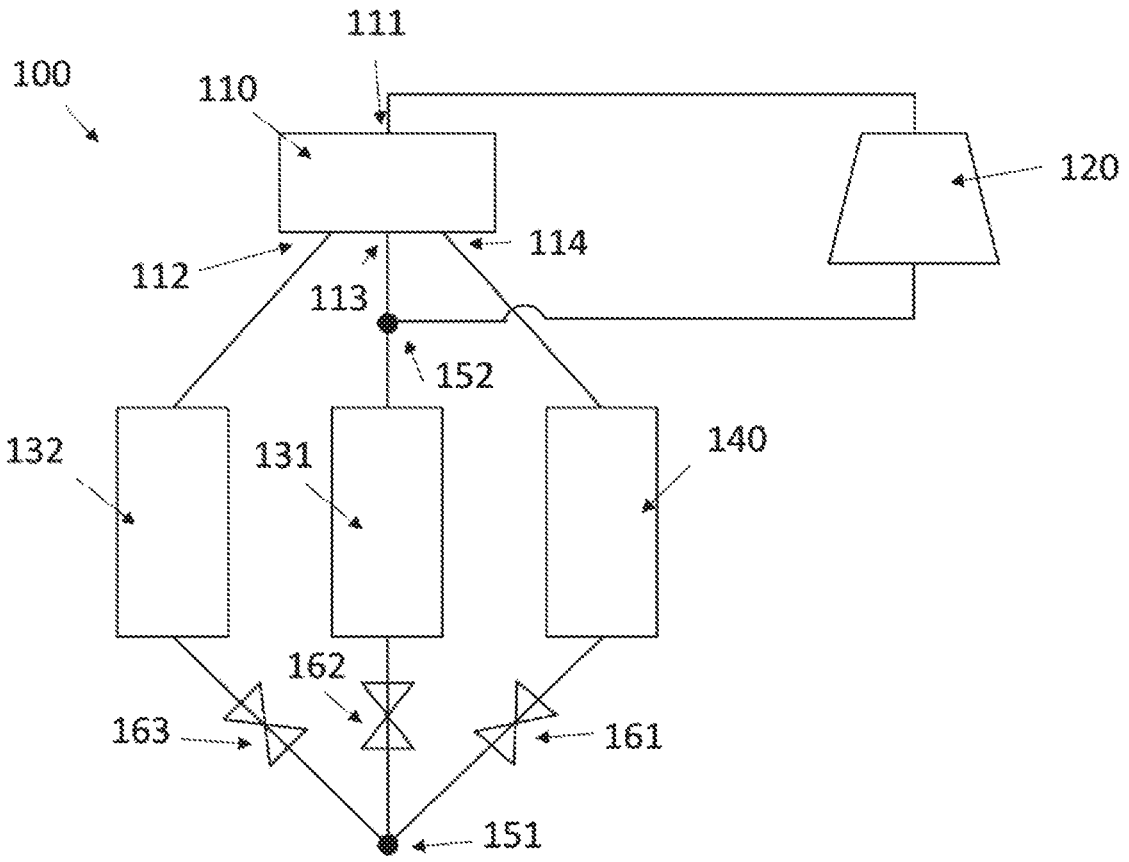
FIG. 3 is a schematic structural view of another embodiment of an air conditioning system of the present application.

A first end of the second evaporator 132 is in fluid communication with one of the second port 112 and the fourth port 114, and a first end of the condenser 140 is in fluid communication with the other of the second port 112 and the fourth port 114. FIGS. 1 and 2 illustrate a situation where the first end of the second evaporator 132 is in fluid communication with the fourth port 114, and FIG. 3 illustrates a situation where the first end of the second evaporator 132 is in fluid communication with the second port 112. Correspondingly, the first end of the condenser 140 is in fluid communication with the second port 112 in FIGS. 1 and 2, and is in fluid communication with the fourth port 114 in FIG. 3.

In addition, a second end of the condenser 140, a second end of the first evaporator 131, and a second end of the second evaporator 132 are in fluid communication at a first node 151, and a first throttling valve 161, a second throttling valve 162 and a third throttling valve 163 are respectively disposed between the condenser 140 and the first node 151, between the first evaporator 131 and the first node 151, as well as between the second evaporator 132 and the first node 151.

It is easy to understand that a three-way pipe may be provided at the first node 151 and the second node 152 respectively to achieve communication.

In an embodiment of the present application, the condenser 140 may be any suitable condenser, including for example a finned coil and a fan, etc.

In an embodiment of the present application, the first evaporator 131 and the second evaporator 132 may be any suitable heat exchangers, such as a Braze Plate Heat Exchanger (BPHE), and the like. The output of the heat exchanger may be any suitable medium, such as water. Therefore, in an embodiment of the present application, a heat exchanger may be used to provide cooled water or heated water.

In an embodiment of the present application, the first throttling valve 161, the second throttling valve 162, and the third throttling valve 163 may be electronic expansion valves (EXV). Therefore, each throttling valve may be selectively opened or closed according to control instruction, thereby opening or closing the flow path in which the throttling valve is located.

The above-mentioned various components are connected by pipelines, and the pipelines are configured to convey a refrigerant. The refrigerant may be any suitable refrigerant used in an air conditioning device.

Although a single condenser and two evaporators are used in the illustrated embodiment, it is easy to understand that the condenser may be replaced by a plurality of condensers connected together in parallel or in series, and the evaporator may also be replaced by a plurality of evaporators connected together in parallel or in series. In such a situation, the arrangements of the pipelines and the throttling valves will be adjusted accordingly without departing from the scope of the principle shown in the illustrated embodiment.

The operating modes of the air conditioning system according to the present application will be described in detail below with reference to the illustrated embodiment. It is easy to understand that if a structure slightly different from that of the illustrated embodiment is applied to the air conditioning system according to the present application, similar operating modes may be easily achieved by adjusting flow paths of the four-way valve 110 and opening and closing of each throttling valve.

Specifically, the air conditioning system 100 according to the present application may have a first mode in which the four-way valve 110 is in the first state, the third throttling valve 163 is closed, and the first throttling valve 161 and the second throttling valve 162 are opened. At this point, the refrigerant from the compressor 120 will travel through the condenser 140 and the first evaporator 131 in sequence, and then return to the compressor 120 through the second node 152. At this point, the first evaporator 131 is used for cooling alone and the second evaporator does not work.

The air conditioning system 100 may also have a second mode in which the four-way valve 110 is in the first state, the second throttling valve 162 is closed, and the first throttling valve 161 and the third throttling valve 163 are opened. At this point, the refrigerant from the compressor 120 will travel through the condenser 140 and the second evaporator 132 in sequence, then to the second node 152 through the fourth port 114 and the third port 113, and finally return to the compressor 120. At this point, the second evaporator 132 is used for cooling alone and the first evaporator 131 does not work.

The air conditioning system 100 may also have a third mode in which the four-way valve 110 is in the first state, and the first throttling valve 161, the second throttling valve 162, and the third throttling valve 163 are opened. At this point, the refrigerant from the compressor 120 will travel through the condenser 140, and then enter the first evaporator 131 and the second evaporator 132, respectively. The refrigerant flowing through the first evaporator 131 travels to the second node 152, and the refrigerant flowing through the second evaporator 132 then travels to the second node 152 through the fourth port 114 and the third port 113 in sequence. The refrigerant meets at the second node 152 and finally return to the compressor 120. At this point, the first evaporator 131 and the second evaporator 132 are used for cooling together.

The air conditioning system 100 may also have a fourth mode in which the four-way valve 110 is in the second state, the second throttling valve 162 is closed, and the first throttling valve 161 and the third throttling valve 163 are opened. At this point, the refrigerant from the compressor 120 will travel through the second evaporator 132, then travel to the condenser 140 through the first throttling valve 161, then travel to the second node 152 through the second port 112 and the third port 113, and finally return to the compressor 120. At this point, the second evaporator 132 is used for heating and the first evaporator 131 does not work.

The air conditioning system 100 may also have a fifth mode in which the four-way valve 110 is in the second state, the first throttling valve 161 is closed, and the second throttling valve 162 and the third throttling valve 163 are opened. At this point, the refrigerant from the compressor 120 will pass through the first port 111 and the fourth port 114, travel through the second evaporator 132, then pass through the third throttling valve 163, the first node 151, and the second throttling valve 162, travel to the first evaporator 131, then travel to the second node 152, and finally return to the compressor 120. At this point, the second evaporator 132 is used for heating and the first evaporator 131 is used for cooling.

In the fifth mode, the air conditioning system 100 according to an embodiment of the present application is capable of performing heating and cooling operations at the same time. In an embodiment of the present application, two evaporators or heat exchangers can perform cooling and heating respectively in the fifth mode, while also provide heated water and cooled water simultaneously, so that the user can perform heating and cooling operations in different regions in the HVAC system as required, thereby meeting the user's special operating demands.

In addition, the air conditioning system 100 according to an embodiment of the present application may also provide the cooling operation alone or the heating operation alone, thereby provide heated water or cooled water, which satisfies the user's common operating demands By providing the condenser, the air conditioning system 100 according to an embodiment of the present application can collect outdoor energy for performing the cooling operation or the heating operation.

The present application has been disclosed herein with reference to the accompanying drawings, and those skilled in the art are also enabled to implement the present application, including manufacturing and using any device or system, selecting suitable materials, and using any combined method. The scope of the present application is defined by the claimed technical solutions, and contains other examples that can be conceived by those skilled in the art. Such other examples should be considered as falling within the scope of protection determined by the technical solutions claimed in the present application, as long as such other examples include structural elements that are not different from the literal language of the claimed technical solutions, or such other examples include equivalent structural elements that are not substantively different from the literal language of the claimed technical solutions.

What is claimed is:

1. An air conditioning system characterized in that it comprises:

a four-way valve comprising a first port, a second port, a third port and a fourth port, wherein at least the first port and the third port are fluidly isolated;

a compressor, an output end and an input end of which are in fluid communication with the first port and the third port respectively;

a first evaporator, a first end of which is in fluid communication with the third port;

a second evaporator, a first end of which is in fluid communication with one of the second port and the fourth port;

a condenser, a first end of which is in fluid communication with the other of the second port and the fourth port;

wherein a second end of the condenser, a second end of the first evaporator, and a second end of the second evaporator are in fluid communication at a first node, and a first throttling valve, a second throttling valve and a third throttling valve are respectively disposed between the condenser and the first node, between the first evaporator and the first node, as well as between the second evaporator and the first node;

wherein the condenser comprises a finned coil and a fan;

wherein the first throttling valve, the second throttling valve, and the third throttling valve are electronic expansion valves.

2. The air conditioning system according to claim 1, wherein the four-way valve has a first state and a second state; in the first state, the first port is in fluid communication with the second port, and the third port is in fluid communication with the fourth port; and in the second state, the first port is in fluid communication with the fourth port, and the second port is in fluid communication with the third port.

3. The air conditioning system according to claim 1, wherein the evaporator comprises a plate heat exchanger.

4. The air conditioning system according to claim 2, wherein the air conditioning system has a first mode in which the four-way valve is in the first state, the third throttling valve is closed, and the first throttling valve and the second throttling valve are opened so that the first evaporator is used for cooling alone and the second evaporator does not work.

5. The air conditioning system according to claim 2, wherein the air conditioning system has a second mode in which the four-way valve is in the first state, the second throttling valve is closed, and the first throttling valve and the third throttling valve are opened so that the second evaporator is used for cooling alone and the first evaporator does not work.

6. The air conditioning system according to claim 2, wherein the air conditioning system has a third mode in which the four-way valve is in the first state, and the first throttling valve, the second throttling valve, and the third throttling valve are opened so that the first evaporator and the second evaporator are used for cooling together.

7. The air conditioning system according to claim 2, wherein the air conditioning system has a fourth mode in which the four-way valve is in the second state, the second throttling valve is closed, and the first throttling valve and the third throttling valve are opened so that the second evaporator is used for heating and the first evaporator does not work.

8. The air conditioning system according to claim 2, wherein the air conditioning system has a fifth mode in which the four-way valve is in the second state, the first throttling valve is closed, and the second throttling valve and the third throttling valve are opened so that the second evaporator is used for heating and the first evaporator is used for cooling.

* * * * *